US008584476B2

(12) United States Patent
Kim et al.

(10) Patent No.: US 8,584,476 B2
(45) Date of Patent: Nov. 19, 2013

(54) AIR CONDITIONER AND METHOD FOR CONTROLLING THE SAME

(75) Inventors: Won Seok Kim, Changwon-si (KR); Jie Seop Sim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 910 days.

(21) Appl. No.: 12/451,488

(22) PCT Filed: Oct. 22, 2007

(86) PCT No.: PCT/KR2007/005187

§ 371 (c)(1),
(2), (4) Date: Mar. 24, 2010

(87) PCT Pub. No.: WO2008/153251

PCT Pub. Date: Dec. 18, 2008

(65) Prior Publication Data

US 2010/0192599 A1 Aug. 5, 2010

(30) Foreign Application Priority Data

Jun. 14, 2007 (KR) ..... 10-2007-0058517

(51) Int. Cl.
*F25D 21/06* (2006.01)

(52) U.S. Cl.
USPC ..... 62/154; 62/155; 62/156; 62/272

(58) Field of Classification Search
USPC ..... 62/80, 128, 151, 154, 155, 272, 275, 62/156; 340/580
See application file for complete search history.

(56) References Cited

U.S. PATENT DOCUMENTS 6,298,679 B1 * 10/2001 Cheng et al. ..... 62/275
6,332,331 B1 * 12/2001 Cheng et al. ..... 62/275
6,397,619 B1 * 6/2002 Cheng et al. ..... 62/272

FOREIGN PATENT DOCUMENTS

JP 6-80381 B2 10/1994
JP 06-317366 11/1994
JP 07-091782 4/1995
JP 2007-093071 4/2007

* cited by examiner

*Primary Examiner* — Marc Norman
(74) *Attorney, Agent, or Firm* — McKenna Long Aldridge LLP

(57) ABSTRACT

An air conditioner is provided. The air conditioner includes a heat exchanger which exchanges heat with air by passing a coolant therethrough; an anti-freeze apparatus which prevents the freeze of water on the surface of the heat exchanger by supplying energy to the heat exchanger; and a control unit which controls the anti-freeze apparatus according to operating conditions of the air conditioner. Therefore, the air conditioner can effectively prevent the freeze of water, if any, on the surface of the heat exchanger.

3 Claims, 13 Drawing Sheets

0 REFERENCE CURVE(0W)
V FIFTH ENERGY CURVE(0.36W)
IV FIFTH ENERGY CURVE(0.62W)
III FOURTH ENERGY CURVE(0.91W)
II SECOND ENERGY CURVE(0.98W)
I FIRST ENERGY CURVE(1.38W)

AIR CONDITIONER AND METHOD FOR CONTROLLING THE SAME

This application is a 35 U.S.C. §371 National Stage entry of International Application No. PCT/KR2007/005187, filed on Oct. 22, 2007, which claims priority to Korean Application No. 10-2007-0058517, filed Jun. 14, 2007, both of which are hereby incorporated by reference in their entireties as if fully set forth herein.

TECHNICAL FIELD

The present invention relates to an air conditioner and a method of controlling the same, and more particularly, to an air conditioner and a method of controlling the same in which the surface of a heat exchanger can be prevented from freezing by supplying energy to the heat exchanger.

BACKGROUND ART

Air conditioners are devices for cooling and cooling indoor rooms using a cooling cycle including a compressor, a condenser, an expansion device, and an evaporator. During the operation of a cooling cycle of an air conditioner, i.e., during the operation of a compressor, water in the air is condensed on the surface of an evaporator, and thus, compressed water is generated. Then, the compressed water drops below the evaporator. However, if the compressed water freezes up on the surface of the evaporator due to low-temperature air around the evaporator, the performance of the air conditioner may deteriorate due to an unsmooth heat exchange between a coolant and air.

In order to address this, the operation of a compressor may be stopped in the middle of the operation of an air conditioner so that the operation of the air conditioner can also be stopped. Then, a defrost operation may be performed for a predetermined amount of time so that the surface of an evaporator can be defrosted. Once the surface of the evaporator is completely defrosted, the operation of the compressor may be resumed so that the operation of the air conditioner can be resumed.

However, since a defrost operation can be performed only after the operation of an air conditioner is stopped, a cooling function or a heating function cannot be performed during a defrost operation, thereby reducing user convenience.

DISCLOSURE

Technical Problem

The present invention provides an air conditioner which can remove ice and/or prevent the freeze of water on the surface of a heat exchanger so that the performance of the air conditioner can be prevented from deteriorating, and that an air conditioning function can be efficiently performed.

The present invention also provides an air conditioner which can remove ice and/or prevent the freeze of water on the surface of a heat exchanger while continuously performing its operation.

The present invention also provides a method of controlling an air conditioner in which an anti-freeze operation and a heating operation are performed at the same time so that water can be effectively prevented from freezing.

Technical Solution

According to an aspect of the present invention, there is provided an air conditioner including a heat exchanger which exchanges heat with air by passing a coolant therethrough; an anti-freeze apparatus which prevents the freeze of water on the surface of the heat exchanger by supplying energy to the heat exchanger; and a control unit which controls the anti-freeze apparatus according to operating conditions of the air conditioner.

The anti-freeze apparatus may include an electrode unit which includes a plurality of electrodes that generate an electric field in the heat exchanger; and a voltage generation unit which applies a voltage to the electrodes.

The control unit may control the voltage generation unit to apply a voltage having a predetermined magnitude and belonging to a predetermined frequency band to the electrode unit.

The predetermined frequency band may be 0.5-500 kHz and the predetermined magnitude is 0.5-10 KV.

The predetermined frequency band may be 0.5-40 kHz and the predetermined magnitude is 0.5-1 KV.

The air conditioner may also include a temperature sensing unit which senses the temperature of at least one of a pipe connected to the heat exchanger, the outside of a room in which the air conditioner is installed, and the heat exchanger, wherein the control unit controls the voltage generation unit according to the results of the sensing performed by the temperature sensing unit.

The control unit may increase at least one of the magnitude and the frequency of a voltage generated by the voltage generation unit if the results of the sensing performed by the temperature sensing unit are low.

The air conditioner may also include a current detection unit which detects a current that flows into the electrode unit, wherein the control unit controls the voltage generation unit according to the result of the detection performed by the current detection unit.

The control unit may increase at least one of the magnitude and the frequency of a voltage generated by the voltage generation unit if the results of the sensing, performed by the temperature sensing unit are high.

The control unit may not apply a voltage to the voltage generation unit if the result of the detection performed by the current detection unit is 0.

The air conditioner may be a heat pump comprising a compressor, a cooling/heating switching valve, an outdoor heat exchanger, an expansion device, and an indoor heat exchanger, and the anti-freeze apparatus may supply energy to the outdoor heat exchanger during a heating operation of the heat pump.

According to another aspect of the present invention, there is provided a method of controlling an air conditioner, the method including, if an air conditioner performs a heating operation, a compressor has been driven for more than a reference time, a predetermined amount of time has elapsed since the initiation of an anti-freeze operation and an outdoor heat exchanger satisfies a set of anti-freeze initiation conditions, supplying energy by driving the anti-freeze apparatus so that water on the surface of the heat exchanger can be prevented from freezing.

The reference time may be ten minutes.

The anti-freeze release conditions may include whether the temperature of at least one of a pipe connected to the heat exchanger, the outside of a room in which the air conditioner is installed, and the heat exchanger is lower than a reference temperature.

The reference temperature may be 0° C.

The method may also include, if the heat exchanger satisfies a set of anti-freeze release conditions, terminating an operation of the anti-freeze apparatus.

The anti-freeze release conditions may include whether the temperature of at least one of a pipe connected to the heat exchanger, the outside of the room, and the heat exchanger is higher than the reference temperature.

If the anti-freeze apparatus comprises an electrode unit which includes a plurality of electrodes that generate an electric field in the heat exchanger and a voltage generation unit which applies a voltage to the electrodes, the anti-freeze initiation conditions may include whether the result of detection performed by a current detection unit, which detects a current that flows into the electrode unit, is higher than a reference value.

The method may also include, if the heat exchanger satisfies a set of anti-freeze release conditions, terminating an operation of the anti-freeze apparatus, wherein the anti-freeze release conditions comprise whether the heating operation has been terminated or whether the result of the detection performed by the current detection unit is lower than the reference value.

According to another aspect of the present invention, there is provided a method of controlling an air conditioner, the method including, if an air conditioner performs a heating operation and an outdoor heat exchanger satisfies a set of anti-freeze initiation conditions, supplying energy by driving the anti-freeze apparatus so that water on the surface of the heat exchanger can be prevented from freezing.

Advantageous Effects

The air conditioner according to the present invention can effectively prevent the freeze of water, if any, on the surface of a heat exchanger by driving an anti-freeze apparatus or terminating an operation of the anti-freeze apparatus according to the operating conditions thereof.

The air conditioner according to the present invention includes an anti-freeze apparatus which has a plurality of electrodes for generating an electric field in the heat exchanger and a voltage generation unit for applying a voltage to the electrodes. Thus, the air conditioner according to the present invention has higher durability and higher reliability than a conventional air conditioner including an anti-freeze apparatus having a mechanical vibrator.

The air conditioner according to the present invention performs an anti-freeze operation for the heat exchanger under optimum conditions for preventing the freeze of water. Thus, the air conditioner according to the present invention can efficiently prevent the freeze of water on the surface of the heat exchanger.

The air conditioner according to the present invention controls the voltage generation unit according to a temperature measurement of a pipe connected to the heat exchanger, the heat exchanger or outside a room in which the air conditioner is installed and can thus adjust its power consumption according to the amount of water on the surface of the heat exchanger. Therefore, it is possible to minimize the power consumption of an air conditioner.

The air conditioner according to the present invention can precisely determine the amount of water on the surface of the heat exchanger by controlling the voltage generation unit according to a current that flows into the electrode unit. Therefore, it is possible to minimize the power consumption of an air conditioner and improve the precision and reliability of an air conditioner.

The air conditioner according to the present invention adjusts at least one of the magnitude and the frequency of a voltage applied to the electrode unit according to the amount of water on the surface of the heat exchanger. Therefore, the air conditioner according to the present invention can dynamically respond to a variation in the amount of water on the surface of the heat exchanger.

The method of controlling an air conditioner according to the present invention includes driving an anti-freeze apparatus and terminating an operation of the anti-freeze apparatus according to whether a set of conditions are met and the temperature of an air conditioner. Therefore, it is possible to efficiently prevent and estimate the freeze of water on the surface of a heat exchange and to improve the precision and reliability of an air conditioner.

BEST MODE

Figure 1:
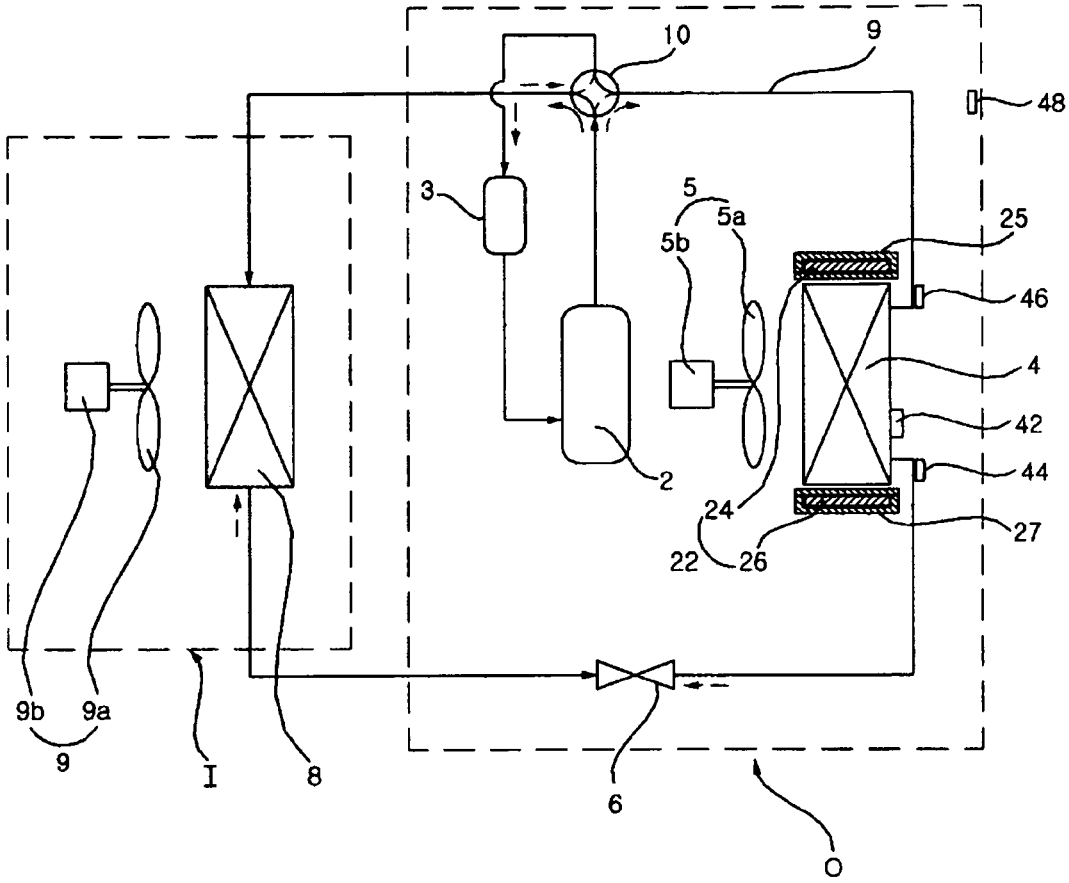
FIG. 1 illustrates a schematic diagram of an air conditioner according to an embodiment of the present invention.
Figure 2:
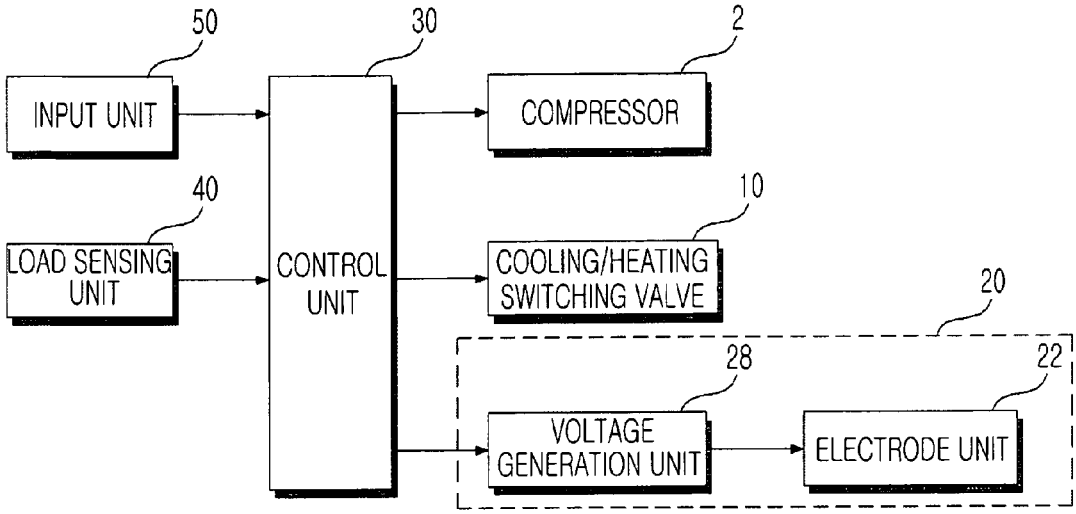
FIG. 2 illustrates a block diagram of the air conditioner illustrated in FIG. 1.

FIG. 1 illustrates a schematic diagram of an air conditioner according to an embodiment of the present invention, and FIG. 2 illustrates a block diagram of the air conditioner illustrated in FIG. 1.

Referring to FIGS. 1 and 2, the air conditioner includes a compressor 2, an outdoor heat exchanger 4, an expansion device 6, an indoor heat exchanger 8, and an anti-freeze apparatus 20 which supplies energy to the compressor 2, the outdoor heat exchanger 4, the expansion device 6 and the indoor heat exchanger 8 and can thus prevent water, if any, on the surfaces of the compressor 2, the outdoor heat exchanger 4, the expansion device 6 and the indoor heat exchanger 8 from freezing.

The air conditioner may be either an air cooler which can cool indoor rooms or a heat pump which not only can cool but also can heat indoor rooms. If the air conditioner is an air cooler, a coolant compressed by the compressor 2 is condensed by passing through the outdoor heat exchanger 5, and the condensed coolant is expanded by passing through the expansion device 6. The expanded coolant is evaporated by the indoor heat exchanger 8. Then, the evaporated coolant is circulated back into the compressor 2. That is, the outdoor heat exchanger 4 may serve as a condenser, and the indoor heat exchanger 8 may serve as an evaporator.

On the other hand, if the air conditioner is a heat pump, rather than an air cooler, the air conditioner may also include a cooling/heating switching valve 10 which shifts the passage of flow of a coolant compressed by the compressor 2 according to whether the air conditioner performs a cooling operation or a heating operation. During a cooling operation, a coolant compressed by the compressor 2 is circulated into the compressor 2 by sequentially passing through the cooling/heating switching valve 10, the outdoor heat exchanger 4, the expansion device 6, the indoor heat exchanger 4, and the cooling/heating switching valve 10. In this case, the outdoor heat exchanger 4 may serve as a condenser, and the indoor heat exchanger 8 may serve as an evaporator.

On the other hand, during a heating operation, a coolant compressed by the compressor 2 is circulated into the compressor 2 by sequentially passing through the cooling/heating switching valve 10, the indoor heat exchanger 8, the expansion device 6, the outdoor heat exchanger 5, and the cooling/heating switching valve 10. In this case, the indoor heat exchanger 8 may serve as a condenser, and the outdoor heat exchanger 4 may serve as an evaporator.

During the operation of the air conditioner, water is generated on the surface of the outdoor heat exchanger 4 or on the surface of the indoor heat exchanger 8. More specifically, if the air conditioner is an air cooler, water may be generated on the surface of the indoor heat exchanger 8. If the air conditioner is a heat pump and performs a cooling operation, water may be generated on the surface of the indoor heat exchanger 8. If the air conditioner is a heat pump and performs a heating operation, water may be generated on the surface of the outdoor heat exchanger 4. Such water on the surface of the outdoor heat exchanger 4 or the indoor heat exchanger 8 may freeze up at low temperature and may thus adversely affect the heat exchange performance of the air conditioner. Therefore, it is necessary to establish an atmosphere in which water on the surface of the outdoor heat exchanger 4 or the indoor heat exchanger 8 can be prevented from freezing even at low temperature.

The anti-freeze apparatus 20 prevents water on the surface of the outdoor heat exchanger 4 or the indoor heat exchanger 8 from freezing. If the air conditioner is an air cooler, the anti-freeze apparatus 20 may be disposed so that energy can be supplied to the indoor heat exchanger 8, and that water on the surface of the indoor heat exchanger 8 can be prevented from freezing. If the air conditioner is a heat pump, the anti-freeze apparatus 20 may be disposed so that energy can be supplied not only to the indoor heat exchanger 8 but also to the outdoor heat exchanger 8, and that water on the surface of the indoor heat exchanger 8 or the outdoor heat exchanger 4 can be prevented from freezing.

The anti-freeze apparatus 20 may prevent the freezing of water by using the phenomenon of super cooling, which is the cooling of a liquid below its freezing point without it becoming solid. The anti-freeze apparatus 20 may include a mechanical vibrator and thus prevent the freezing of water by applying mechanical vibrations to whichever of the outdoor heat exchanger 4 and the indoor heat exchanger 8 serves as an evaporator.

However, an anti-freeze apparatus 20 having a mechanical vibrator may damage the connections between a coolant pipe and whichever of the outdoor heat exchanger 4 and the indoor heat exchanger 8 serves as an evaporator, and thus may not be suitable for use in an air conditioner. Therefore, an anti-freeze apparatus 20 using the phenomenon of super cooling may be suitable for use in an air conditioner.

In general, when the temperature of an indoor room is below zero, it is more likely to perform a heating operation than to perform a cooling operation. Therefore, the anti-freeze apparatus 20 may supply energy so that water on the surface of the outdoor heat exchanger 4 can be prevented from freezing during a heating operation performed by a heat pump. However, people from cold climates may feel hot even at temperatures below zero and may thus need a cooling operation. In this case, water on the surface of the indoor heat exchanger 8 may freeze due to such low temperatures. Therefore, it is necessary to prevent water on the surface of the indoor heat exchanger 8 from freezing by using the anti-freeze apparatus 20. By doing so, it is possible to improve the performance of a cooling operation. In addition, since the indoor heat exchanger 8 is cooled by the anti-freeze apparatus 20, it is possible to further improve the performance of a cooling operation.

The outdoor heat exchanger 4 is more likely to be frozen than the indoor heat exchanger 8 due to being exposed to low-temperature outside air. Thus, the operation of the anti-freeze apparatus 20 will hereinafter be described in further detail, focusing mainly on the prevention of water on the surface of the outdoor heat exchanger 4 from freezing during a heating operation of a heat pump.

The anti-freeze apparatus 20 includes an electrode unit 22 which generates an electric field and applies the electric field to the outdoor heat exchanger 4 and a voltage generation unit 28 which applies a voltage, and more particularly, a high-frequency alternating voltage, to the electrode unit 22.

The electrode unit 22 converts a high-frequency alternating voltage provided by the voltage generation unit 28 into an electric field, and applies the electric field to the outdoor heat exchanger 4. The electrode unit 22 may include plates or wires which are formed of a metal such as copper or platinum. More specifically, the electrode unit 22 includes a plurality of electrodes 24 and 26 which are disposed on the opposite sides of the outdoor heat exchanger 4.

The electrodes 24 and 26 may be surrounded by electrode covers 25 and 27, respectively, for safety. The electrode covers 25 and 27 may be formed of a dielectric material. The electrode covers 25 and 27 will be described later in detail.

An electric field generated by the electrode unit 22 is caused by a high-frequency alternating voltage. The polarity of the electric field varies according to the frequency of the high-frequency alternating voltage. Thus, the electric field constantly vibrates and rotates water molecules composed of oxygen with a negative polarity (−) and hydrogen with a positive polarity (+) so that water molecules can be prevented from being crystallized and can thus be maintained to be liquid even at temperatures below the freezing point of water.

The voltage generation unit 28 generates an alternating voltage according to setting values regarding a predetermined voltage magnitude and a predetermined frequency and applies the alternating voltage to the electrode unit 22. The voltage generation unit 28 may vary at least one of the magnitude and frequency of a voltage, thereby generating an alternating voltage. More specifically, the voltage generation unit 28 generates an alternating voltage according to setting values (e.g., setting values regarding a predetermined voltage magnitude and a predetermined frequency) provided by a control unit 30 and applies the alternating voltage to the electrode unit 22 so that the electrode unit 22 can generate an electric field and apply the electric field to the outdoor heat exchanger 4. The voltage generator 28 may vary the frequency of a voltage so that the magnitude of the voltage can vary within the range of 0.5-10 KV. The voltage generator 28 may vary the frequency of a voltage within a high-frequency range ranging from 0.5 kHz to 500 kHz.

The voltage generation unit 28 applies an alternating voltage having a high frequency of 0.5-500 kHz because a voltage having a frequency lower than 0.5 kHz or higher than 500 kHz can only slightly rotate or vibrate water molecules, thereby resulting in the phase transformation of water. A voltage having a magnitude greater than 10 KV may result in dielectric breakdown of electrode covers 25 and 27. An alternating voltage having a frequency higher than 500 kHz may spread in the form of an electric wave, instead of generating an electric field. In addition, the speed at which the polarity of an alternating voltage having a frequency higher than 500 kHz varies may be excessively high so that the movement of water molecules cannot keep up with the variation of the polarity of the alternating voltage. Thus, the optimum frequency and the optimum voltage for a voltage generated by the voltage generation unit 28 may be set to the range of 0.5-500 kHz and the range of 0.5-10 KV, respectively.

If the outdoor heat exchanger 4 or the indoor heat exchanger 8 is a pin/tube-type heat exchanger including a coolant tube, which a coolant flows therethrough and is formed of aluminum or copper, and an aluminum pin, which is disposed in the coolant tube, an electric field generated by the electrode unit 22 may concentrate on the aluminum pin and generate heat due to the resistance of the aluminum pin. In general, when a voltage having a voltage of about 7000 V is applied to a stainless material as a direct current (DC) pulse, the stainless material emits negative ions, and the negative ions give an impulse to water molecules so that the water molecules can be prevented from freezing. By using this phenomenon, it is possible to prevent the freeze of water by applying a high voltage to the aluminum pin so that negative ions emitted from the aluminum pin can give an impulse to water molecules.

That is, it is possible to maintain an anti-freeze state by applying a high voltage to the aluminum pin. In addition, it is possible to reduce the probability of the occurrence of an electric shock by grounding the aluminum pin and providing an additional active electrode.

The air conditioner may also include the control unit 30 which controls the anti-freeze apparatus 20, and more particularly, the voltage generation unit 28, according to operating conditions of the air conditioner.

The control unit 30 may control the anti-freeze apparatus 20 according to the result of sensing performed by the load sensing unit 40 which determines the existence, the freeze, and the amount of water on the surface of the outdoor heat exchanger 4. The load sensing unit 40 may include a temperature sensing unit which senses the temperature of a pipe connected to the outdoor heat exchanger 4, the temperature of the outdoor heat exchanger 4 or the temperature outside the room where the air conditioner is installed. Alternatively, the load sensing unit 40 may include a current detection unit or a voltage detection unit which detects a current or a voltage generated by an electric field in the outdoor heat exchanger 4 during the operation of the anti-freeze apparatus 20.

If the load sensing unit 40 is a temperature sensing unit, the load sensing unit 40 may include at least one of an outdoor heat exchanger temperature sensor 42 which senses the temperature of the outdoor heat exchanger 4, an inlet temperature sensor 44 which senses the temperature of a pipe at the inlet of the outdoor heat exchanger 4, an outlet temperature sensor 46 which senses the temperature of a pipe at the outlet of the outdoor heat exchanger 4, and an outdoor temperature sensor 48 which senses the temperature outside the air conditioner.

The control unit 30 may determine the existence, the freeze, and the amount of water on the surface of the outdoor heat exchanger 4 based on the result of the sensing performed by at least one of the outdoor heat exchanger temperature sensor 42, the inlet temperature sensor 44, the outlet temperature sensor 46, and the outdoor temperature sensor 48. Then, the control unit 30 may determine whether to operate the voltage generation unit 28 and determine a frequency and a voltage magnitude for the voltage generation unit 28. In addition, the control unit 30 may determine whether to operate the heat generation unit 30 and determine a control temperature for the heat generation unit 30.

If the load sensing unit 40 is a current detection unit or a voltage detection unit, the control unit 30 may determine the existence, the freeze and the amount of water on the surface of the outdoor heat exchanger 4 based on a variation in the resistance of the current detection unit or the voltage detection unit because the resistance of the current detection unit or the voltage detection unit varies according to whether there is water on the surface of the outdoor heat exchanger 4 and how much water there is on the surface of the outdoor heat exchanger 4. Then, the control unit 30 may decide whether to drive the voltage generation unit 28 and determine the magnitude and frequency of a voltage to be generated by the voltage generation unit 28.

The control unit 30 may control the anti-freeze apparatus 20 not only by using the load sensing unit 40 but also by taking into consideration whether the air conditioner performs a heating operation. The control of the anti-freeze apparatus 20 by the control unit 30 will hereinafter be described in further detail.

The control unit 30 controls the anti-freeze apparatus 20 using at least one of the following conditions: whether the air conditioner performs a heating operation, the amount of time for which long the compressor 2 of the air conditioner has been continuously driven, a water load condition, and an elapsed time after the initiation of an anti-freezing operation.

Referring to FIG. 1, reference numeral 3 indicates an accumulator which is disposed between the compressor 2 and a suction tube 2*a* and in which a coolant accumulates; reference numeral 5 indicates an outdoor blower 5 which includes an outdoor fan 5*a* that blows air into the outdoor heat exchanger 4 and a motor 5*b* that rotates the outdoor fan 5*a*; and reference numeral 9 indicates an indoor blower 5 which includes an outdoor fan 9*a* that blows air into the indoor heat exchanger 9 and a motor 9*b* that rotates the outdoor fan 9*a*. Referring to FIG. 2, reference numeral 50 indicates a control panel or an input unit of a remote control which is installed in an indoor unit I of FIG. 1 and enables a user to select various operating modes and an anti-freeze operation.

The embodiment of FIGS. 1 and 2 may be applied not only to an integral-type air conditioner in which an indoor unit and an outdoor unit are both integrated in one case but also to a separate-type air conditioner in which an indoor unit and an outdoor unit are separate. Assume that the anti-freeze apparatus 20 is disposed in an outdoor unit O of the air conditioner illustrated in FIG. 1.

Figure 3:
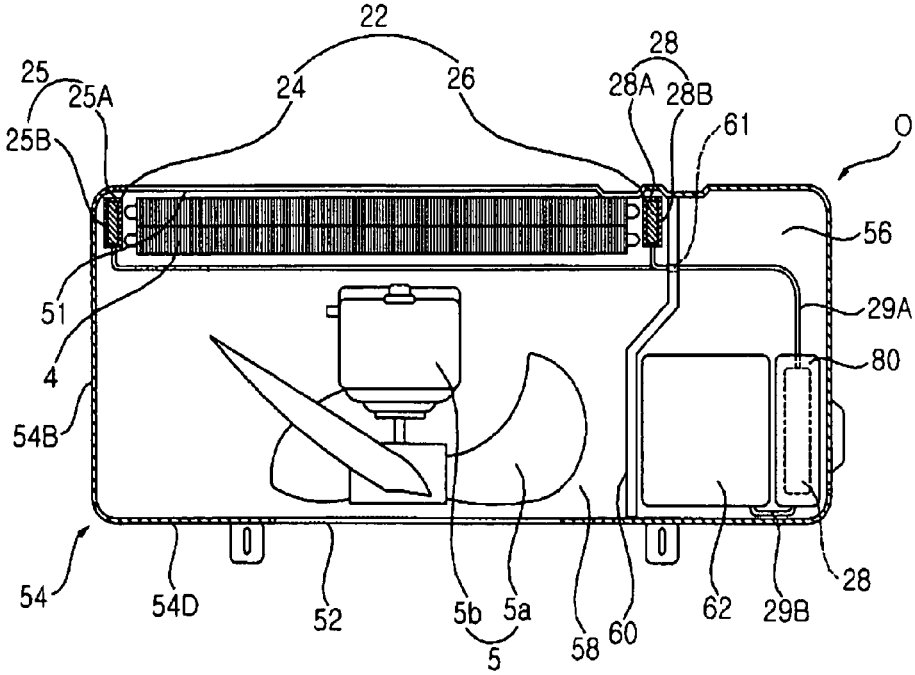
FIG. 3 illustrates a plan view of an outdoor unit of the air conditioner illustrated in FIG. 1.
Figure 4:
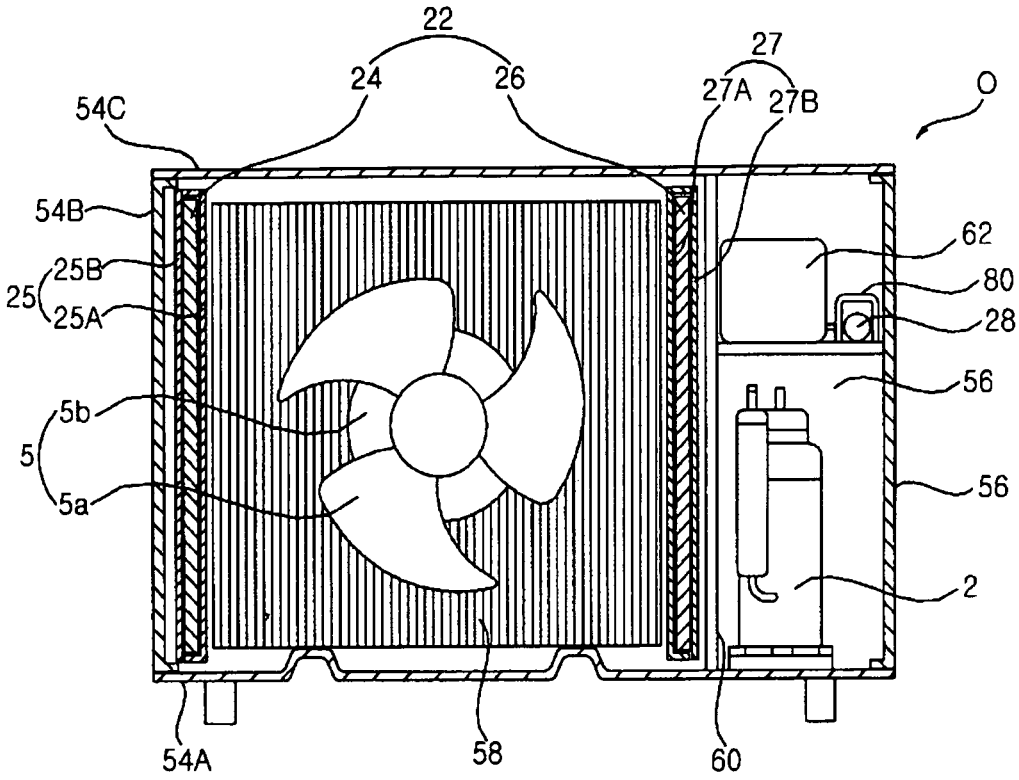
FIG. 4 illustrates a front view of the outdoor unit illustrated in FIG. 3.

FIG. 3 illustrates a plan view of the outdoor unit O, and FIG. 4 illustrates a front view of the out door unit O illustrated in FIG. 3.

Referring to FIGS. 3 and 4, the outdoor unit O includes a casing 54 which has an air inlet 51 and an air outlet 52 through which air is injected into and ejected from the casing 54; and a barrier wall 60 which is divides the inner space of the casing 54 into a machine room 56 and a flow path room 58. The compressor 2 is disposed in the machine room 56, and the outdoor heat exchanger 4 is disposed in the flow path room 58.

The accumulator 3 and the expansion device 6 are disposed in the machine room 56 of the outdoor unit O along with the compressor 2.

The casing 54 includes a base 54A which has legs; a cabinet 54B which is disposed on the base 54A and has an air inlet 51 disposed on at least one surface of the cabinet 54B; a front cover 54C which is disposed at the front of the cabinet 54B and has an air outlet 52; and a top cover 54D which covers the top of the cabinet 54B.

The casing 54 may be entirely formed of a dielectric material. Alternatively, only the portions of the casing 54 near the electrodes 24 and 26 may be formed of a dielectric material.

The outdoor unit O may be installed so that the outdoor heat exchanger 4 can become in the vicinity of the air inlet 51. Only the cabinet 54B of the outdoor unit O, which is adjacent to the outdoor heat exchanger 4, may be formed of a dielectric material. Alternatively, the cabinet 54B and the top cover 54D may be formed of a dielectric material, whereas the base 54A, which needs to have high rigidity, and the front cover 54C, which is relatively distant apart from the electrode unit 22, may be formed of a highly rigid material.

The outdoor blower 5 is disposed in the outdoor unit O. The outdoor fan 5A of the outdoor blower 5 is disposed in the flow path room 58 and between the air inlet 51 and the air outlet 52 so that air can be injected into the outdoor unit O through the air inlet 51 and ejected from the outdoor unit O through the air outlet 52.

The barrier wall 60 may be formed of a dielectric material.

The outdoor unit O also includes a control box 62 in which various automotive electric elements of the control unit 30 such as automotive electric elements for controlling the compressor 2 are installed. The control box 62 may be disposed either in the machine room 56 or in the flow path room 58.

The control box 62 may be disposed above the machine room 56. All or some of the automotive electric elements of the control unit 30 may be installed in the control box 62.

The electrode unit 22, including the electrodes 24 and 26, is disposed in the flow path room 56.

The electrodes 24 and 26 may be disposed not to block the passage of the flow of air from the outside of the outdoor unit O and thus not to interrupt with the flow of air. The electrodes 24 and 26 may be disposed on the left and right sides, respectively, of the outdoor heat exchanger 4. Alternatively, the electrodes 24 and 26 may be disposed above and below, respectively, the outdoor heat exchanger 4. In this case, the electrodes 24 and 26 may be vertically aligned with each other or may be disposed diagonally with respect to the outdoor heat exchanger 4.

The electrode covers 25 and 27 may be electrode housings and cover the electrodes 24 and 26, respectively. The electrode covers 25 and 27 may be formed of a dielectric material such as plastic.

The electrode covers 25 and 27 may include electrode boxes 25A and 27A, respectively, and covers 25B and 27B, respectively. Each of the electrode boxes 25A and 27A has one surface opened and may thus be able to hold the electrode 24 or 26. The covers 25B and 27B respectively cover the opened surfaces of the electrode boxes 25A and 27B. Alternatively, the electrode covers 25 and 27 may be formed as housings through injection molding so that the electrodes 24 and 26 can be inserted into the electrode covers 25 and 27, respectively.

The voltage generation unit 28 may be disposed in the machine room 56 or may be disposed in the flow path room 56 along with the electrode unit 22.

If the voltage generation unit 28 is disposed in the machine room 56, the probability of the voltage generation unit 28 malfunctioning due to an electric field may be minimized, and the voltage generation unit 28 may be easily controlled and serviced due to being adjacent to the control box 62. On the other hand, if the voltage generation unit 28 is disposed in the flow path room 58, heat generated by the voltage generation unit 28 may be dissipated due to air that passes through the flow path room 58, and thus, the stability of the voltage generation unit 28 may be improved.

The voltage generation unit 28 is connected to the electrode unit 22 through a wire 29A and is connected to the control box 62 through a wire 29B. Thus, if the voltage generation unit 28 is disposed in the machine room 56, the wire 29A may pass through the barrier wall 60 or make a detour round the barrier wall 60. On the other hand, if the voltage generation unit 28 is disposed in the flow path room 56, the wire 29B may pass through the barrier wall 60 or make a detour round the barrier wall 60.

A wire through groove or a wire through hole 61 via which at least one of the wires 29A and 29B can pass through the barrier wall 60 may be formed on the barrier wall 60.

Referring to FIGS. 3 and 4, reference numeral 80 indicates a dielectric element which covers the voltage generation unit 28 for the safety of the voltage generation unit 28.

Figure 5:
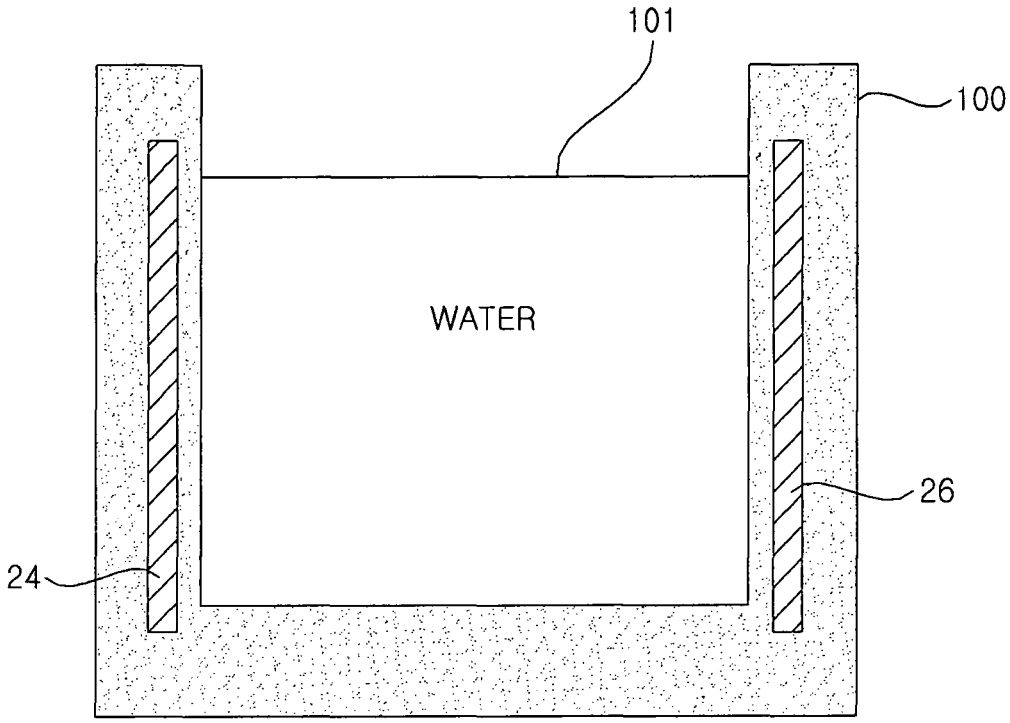
FIG. 5 illustrates a structure for experimenting a super-cooling phenomenon of an air conditioner according to an embodiment of the present invention.

FIG. 5 illustrates a structure for testing a super-cooling phenomenon of an air conditioner according to an embodiment of the present invention.

Referring to FIG. 5, a space 101 for containing water therein is formed in a case 100. 0.1 l of distilled water is contained in the space 101. A plurality of electrodes 24 and 26 are installed inside the case 100 and are disposed at the opposite sides of the space 101. The length of the electrodes 24 and 26 is greater than the height of water in the space 101. The width of the electrodes 24 and 26 is 20 mm. The case 100 is formed of a dielectric material such as an acrylic material. An alternating voltage of 0.91 KV (6.76 mA, 20 kHz) is applied to the electrodes 24 and 26 using a voltage generation unit 28, and the case 100 is cooled so that the temperature in the space 101 can reach about −7° C.

Figure 6:
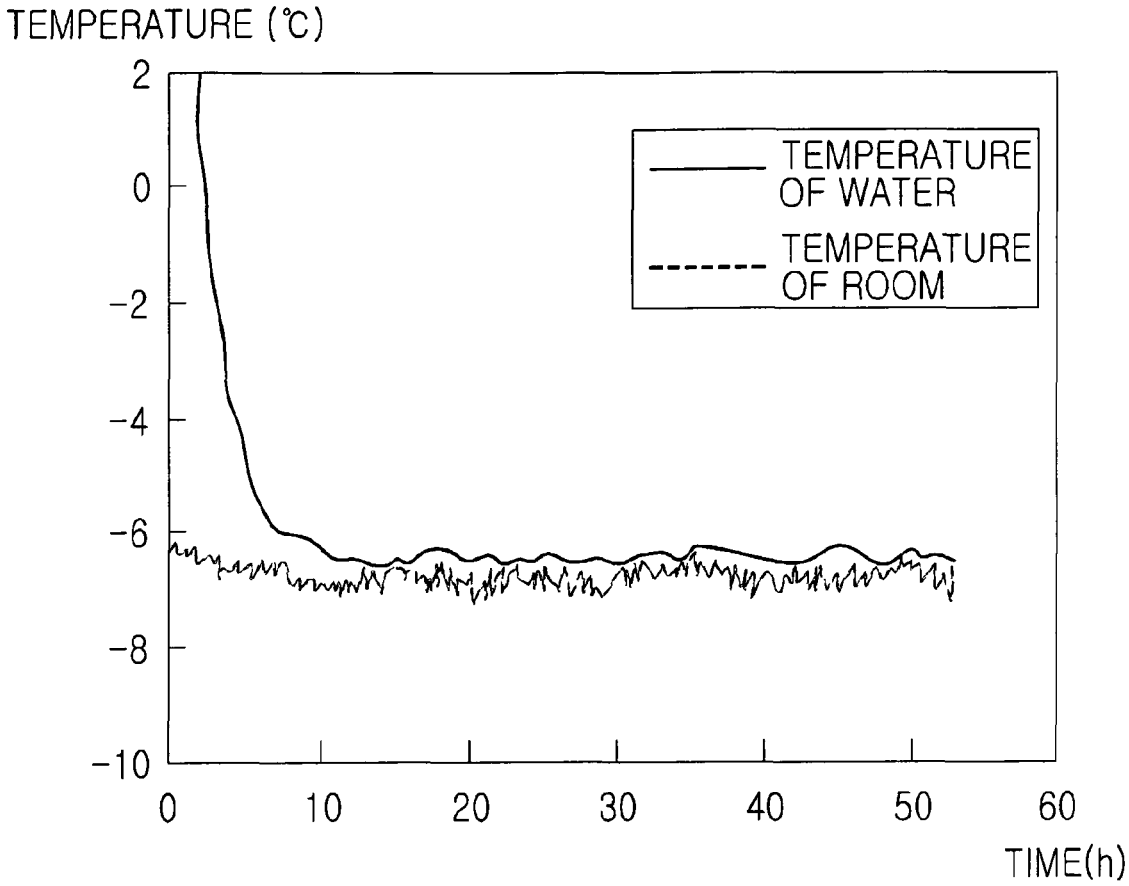
FIG. 6 illustrates a graph of super-cooling measurement results obtained using the structure illustrated in FIG. 5.
Figure 7:
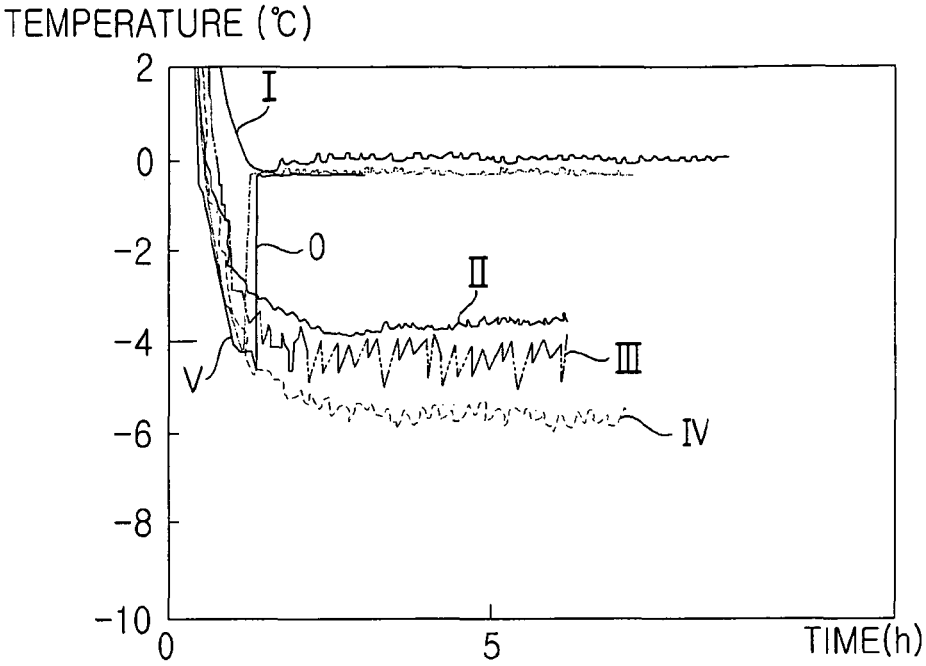
FIG. 7 illustrates a graph of anti-freeze temperature measurements for different amounts of power obtained using the structure illustrated in FIG. 5.

FIG. 6 illustrates a graph of experimental results obtained using the structure illustrated in FIG. 5, and FIG. 7 illustrates a graph of anti-freeze temperature measurement results for different amounts of power obtained using the structure illustrated in FIG. 5. The measurement results of FIG. 7 were obtained by maintaining the temperature of the space 101 of the case 100 at −6° C., setting a plurality of amounts of power to be applied by the voltage generation unit 28, and applying the plurality of amounts of power. Referring to a reference line O of FIG. 7, when no power is applied, an anti-freeze state is maintained until the temperature of the space 101 reaches −5° C. Then, a freeze state begins less than three hours after the onset of the anti-freeze state.

Referring to a first energy line I (1.38 W) of FIG. 7, since a large amount of energy is applied to water, the temperature of water is almost uniformly maintained at 0° C., and thus, super cooling does not occur even if water begins to freeze at its freezing point (a temperature of 0° C. at a pressure of 1 atm).

Referring to a second energy line II (0.98 W) of FIG. 7, an anti-freeze state caused by a super cooling phenomenon is maintained, and an anti-freeze temperature is maintained within the range of −3° C. and −3.5° C.

Referring to a third energy line III (0.91 W) of FIG. 7, an anti-freeze state caused by a super cooling phenomenon is maintained, and an anti-freeze temperature is maintained within the range of −4° C. and −5° C.

Referring to a fourth energy line IV (0.62 W) of FIG. 7, an anti-freeze state caused by a super cooling phenomenon is maintained, and an anti-freeze temperature is maintained within the range of −5.5° C. and −5.8° C.

Referring to a fifth energy line V (0.36 W), no super cooling state is achieved, so water freezes, i.e., a phase transition of water occurs.

Figure 8:
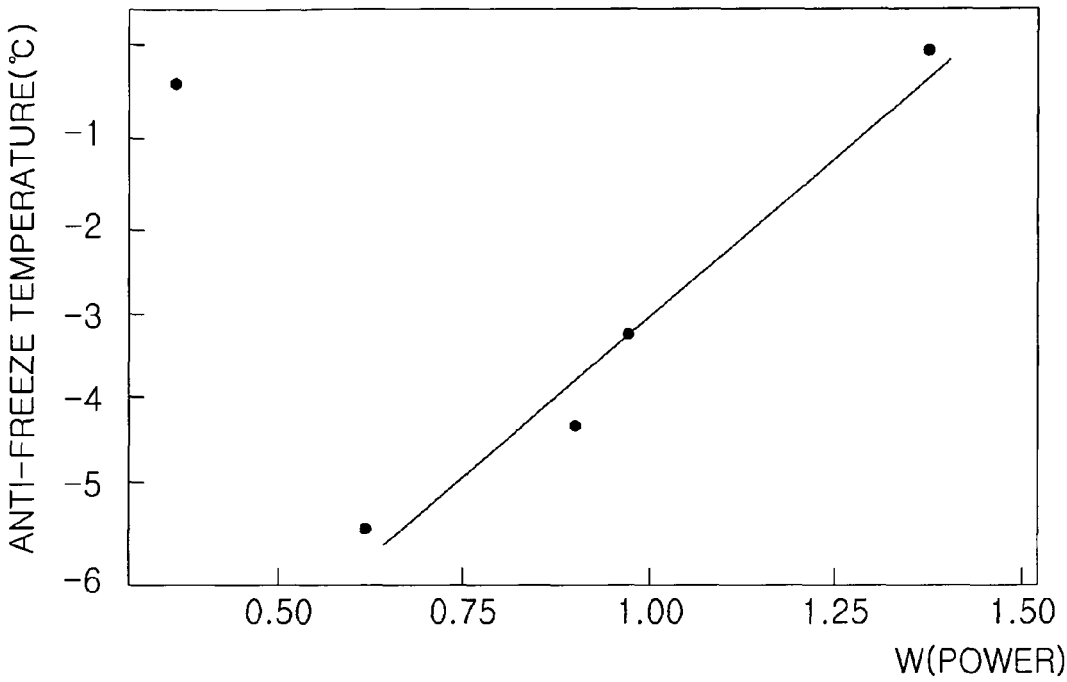
FIG. 8 illustrates a graph of the correlation between first through fifth energy lines illustrated in FIG. 7.

FIG. 8 illustrates a graph of the correlation between the first through fifth energy lines illustrated in FIG. 7. Referring to FIG. 8, the amount of energy applied to water is proportional to an anti-freeze temperature of water. The greater the amount of energy applied to water, the higher the anti-freeze temperature becomes. On the other hand, the less the amount of energy applied to water, the lower the anti-freeze temperature becomes. However, if too little energy is applied, the motion of water molecules may not be active enough to realize a super cooling state, and thus, water may freeze, as in the case of the fifth energy line of FIG. 7.

Figure 9:
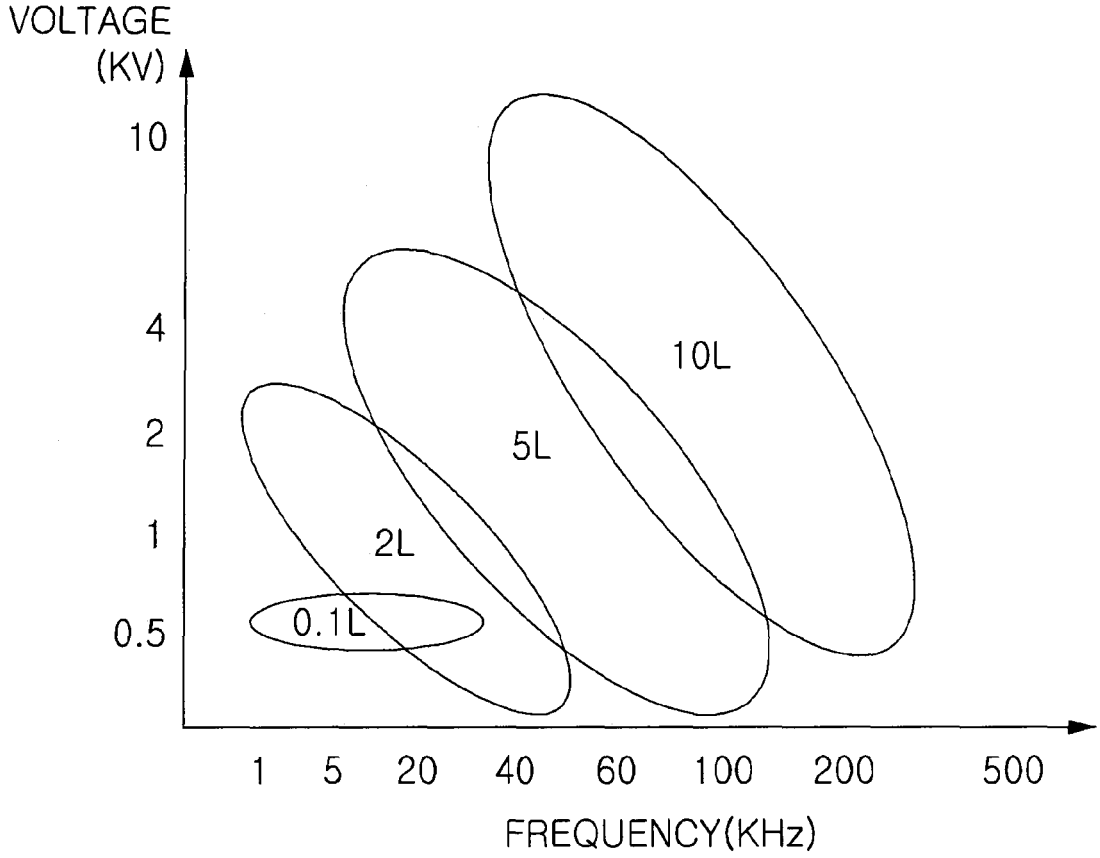
FIG. 9 illustrates a graph of the relationships between a voltage and a frequency for maintaining an anti-freeze state for different amounts of water in an air conditioner.

FIG. 9 illustrates a graph of the relationship between an optimum voltage and an optimum frequency band for maintaining an anti-freeze state for different amounts of water in an air conditioner. Referring to FIG. 9, the optimum voltage and an optimum frequency band for maintaining an anti-freeze state must be appropriately determined in accordance with an increase in the amount of water, for example, from 0.1 l to 2 l, from 2 l to 5 l or from 5 l to 10 l. If the optimum frequency band and the optimum voltage are set to the range of 0.5-500 kHz and the range of 0.5-10 KV, respectively, an anti-freeze state of water may be effectively maintained regardless of a variation in the amount of water. Given that, in general, less than 0.1 l of condensed water is generated regardless of the size of the outdoor heat exchanger 4, the optimum frequency band and the optimum voltage may be set to the range of 0.5-40 kHz and the range of 0.5-1 KV, respectively.

Figure 10:
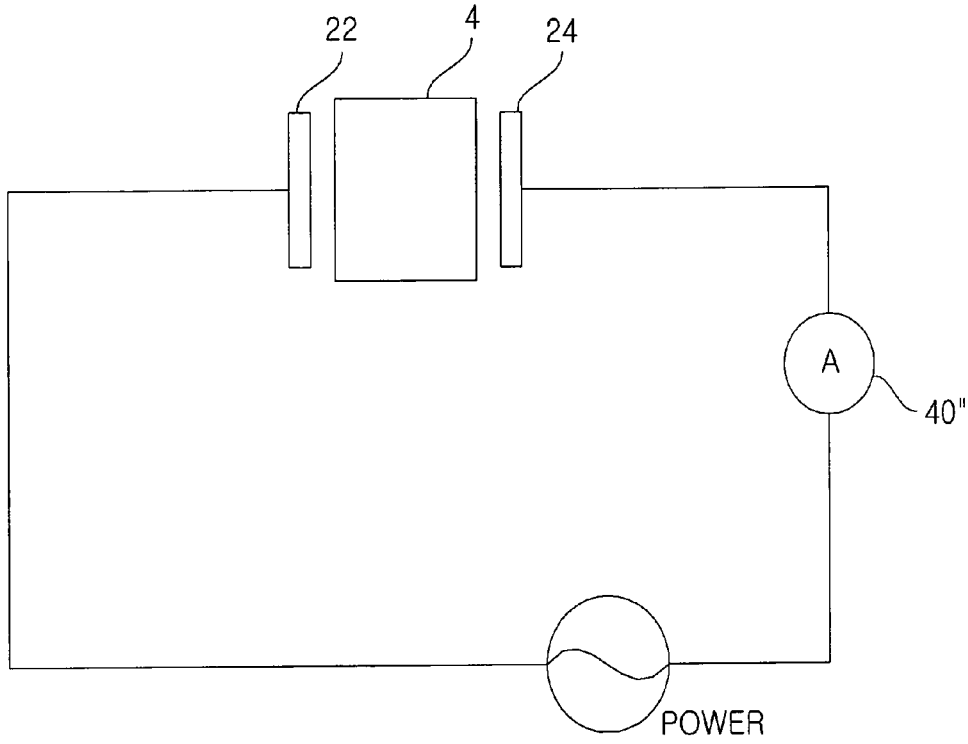
FIG. 10 illustrates a circuit diagram of a current detection structure including a current detection unit illustrated in FIG. 14.
Figure 11:
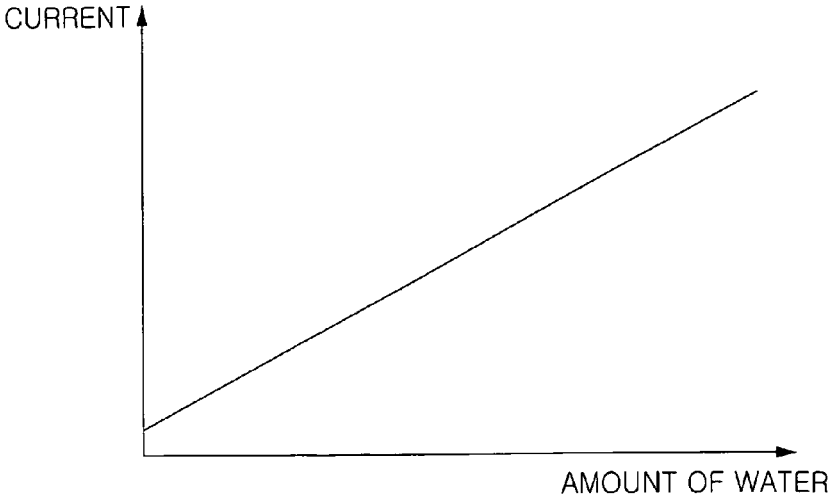
FIG. 11 illustrates a graph of the relationship between a current detected by the current detection unit illustrated in FIG. 14 and the amount of water on the surface of an outdoor heat exchanger.

FIG. 10 illustrates a circuit diagram of a current detection structure including a current detection unit 40' and FIG. 11 illustrates a graph of the relationship between a current detected by the current detection unit and the amount of water on the surface of the outdoor heat exchanger 4.

Referring to FIG. 10, if the load sensing unit 40 includes the current detection unit 40' the current detection unit 40' may be connected in series to a plurality of electrodes 24 and 26. The current detection unit 40? detects a current applied to the electrodes 24 and 26 and a current flowing into the outdoor heat exchanger 4. Referring to FIG. 11, if the result of the detection performed by the current detection unit 40' is close to 0, it is determined that there is a small amount of water on the surface of the outdoor heat exchanger 4. On the other hand, if the result of the detection performed by the current detection unit 40' is high, it is determined that there is a large amount of water on the surface of the outdoor heat exchanger 4. In this manner, the control unit 30 determines the existence and the amount of water on the surface of the outdoor heat exchanger 4 based on the result of the detection performed by the current detection unit 40'.

The operation of the air conditioner of the embodiment of FIGS. 1 and 2 will hereinafter be described in further detail.

Figure 12:
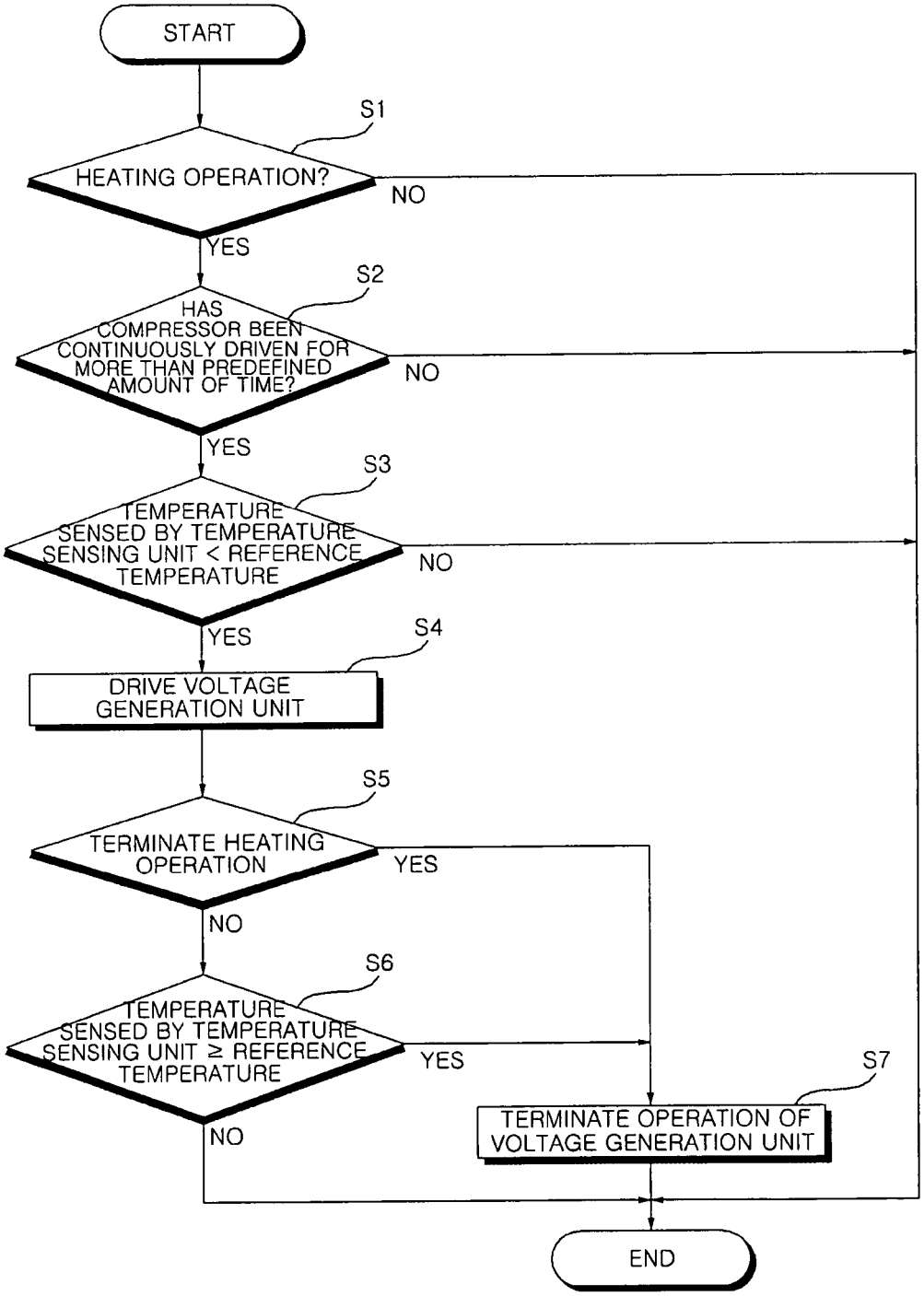
FIG. 12 illustrates a flowchart of a method of controlling an air conditioner according to an embodiment of the present invention.

FIG. 12 illustrates a flowchart of a method of controlling an air conditioner according to an embodiment of the present invention. Referring to FIG. 12, during a cooling operation of the air conditioner, the control unit 30 drives the compressor 2, controls the cooling/heating switching valve 10 to operate in a cooling mode, and drives the motor 9B of the indoor blower 9 and the motor 5B of the outdoor blower 5 (S1).

During a cooling operation of the air conditioner, a coolant sequentially passes through the outdoor heat exchanger 4, the expansion device 6, the indoor heat exchanger 8 and the compressor 2, the indoor heat exchanger 8 removes heat from air in a room in which the air conditioner is installed, and the outdoor heat exchanger 4 releases the heat to the outside of the room while On the other hand, during a heating operation of the air conditioner, the control unit 30 drives the compressor 2, controls the cooling/heating switching valve 10 to operate in a heating mode, and drives the motor 9B of the indoor blower 9 and the motor 5B of the outdoor blower 5.

During a heating operation of the air conditioner, a coolant sequentially passes through the compressor 2, the indoor heat exchanger 8, the expansion device 6, the outdoor heat exchanger 4 and the compressor 2, the outdoor heat exchanger 4 removes heat from air from the outside of the room and the outdoor heat exchanger 4 releases the heat into the room.

During a heating operation of the air conditioner, condensed water is generated on the surface of the outdoor heat exchanger 4. Then, if the compressor 2 has been continuously driven for more than a predefined amount of time (for example, for more than ten minutes) and the outdoor heat exchanger 4 satisfies a set of anti-freeze initiation conditions, the control unit 30 drives the anti-freeze apparatus 20 (S1, S2, S3 and S4).

The anti-freeze initiation conditions are the conditions in which a temperature measurement provided by the load sensing unit 40 reaches a reference temperature. For example, if an outdoor temperature sensed by the outdoor temperature sensor 48 or a temperature of the outdoor heat exchanger 4 detected by the outdoor heat exchanger temperature sensor 42 is lower than the freezing point of water or if the difference between an inlet temperature sensed by the inlet temperature sensor 44 and an outlet temperature sensed by the outlet temperature sensor 46 is less than a reference value, it may be determined that the outdoor heat exchanger 4 satisfies the anti-freeze initiation conditions. For convenience, assume that the outdoor heat exchanger 4 satisfies the anti-freeze initiation conditions because the temperature of the outdoor heat exchanger 4 is lower than a reference temperature of, for example, 0° C.

That is, if the air conditioner is currently performing a heating operation, the compressor 2 has been continuously driven for more than a predefined amount of time and a temperature measurement provided by the load sensing unit 40 is lower than a reference temperature, the control unit 30 may decide to drive the anti-freeze apparatus 20. On the other hand, if the compressor 2 has been continuously driven, but for less than the predefined amount of time or a temperature measurement provided by the load sensing unit 40 is higher than the reference temperature, the control unit 30 may decide not to drive the anti-freeze apparatus 20.

The voltage generation unit 28 applies a voltage having a frequency of 0.5-500 kHz and a magnitude of 0.5-10 KV to the electrode unit 22. More specifically, the voltage generation unit 28 may apply a voltage having a frequency of 0.5-40 kHz and a magnitude of 0.5-1 KV to the electrode unit 22. For convenience, assume that the voltage generation unit 28 may apply a voltage having a frequency of 20 kHz and a magnitude of 0.91 KV (6.76 mA) to the electrode unit 22.

Then, an electric field is generated between the electrodes 24 and 26 of the electrode unit 22. The electric field continuously vibrates and rotates water molecules on the surface of the outdoor heat exchanger 4 so that the water molecules can become in a super-cooling state even before reaching the freezing point of water. Therefore, due to the electric field, water on the surface of the outdoor heat exchanger 4 can be prevented from freezing.

In other words, the air conditioner can perform a heating operation while preventing water on the surface of the outdoor heat exchanger 4 from freezing. Thus, there is no need to perform a defrost operation during a heating operation of the air conditioner.

During the operation of the anti-freeze apparatus 20, the control unit 30 lowers the operating capacity of the air conditioner, and particularly, the operating capacity of the compressor 2 and the expansion device 6, so that severe temperature variations can be prevented, and that an anti-freeze operation can be stably performed.

When a predefined amount of time (e.g., three minutes) elapses after the initiation of the operation of the anti-freeze apparatus 20, the control unit 30 controls the voltage generation unit 28 to reduce the frequency of the voltage applied to the electrodes 24 and 26 of the electrode unit 22 and thus to reduce the power consumption of the air conditioner. The predefined amount of time is the time taken to stabilize an anti-freeze state and may be experimentally determined.

Once the anti-freeze state is stabilized, the motion in water molecules becomes regular and thus becomes less affected by a reduction in the frequency of the voltage applied to the electrodes 24 and 26. Therefore, the anti-freeze state can be uniformly maintained.

During the operation of the anti-freeze apparatus 20, the control unit 30 may adjust at least one of the magnitude and frequency of the voltage generated by the voltage generation unit 28 according to a temperature measurement provided by the temperature sensing unit 40. More specifically, the temperature sensing unit 40 continuously performs temperature sensing during the operation of the anti-freeze apparatus 20, and outputs the result of the temperature sensing to the control unit 30. Then, the control unit 30 determines the magnitude and the frequency of a new voltage to be generated by the voltage generation unit 28 by substituting the result of the temperature sensing into an equation or a table.

More specifically, if the temperature measurement provided by the temperature sensing unit 40, the control unit 30 may increase at least one of the magnitude and frequency of a new voltage to be generated by the voltage generation unit 28. On the other hand, if the temperature measurement provided by the temperature sensing unit 40, the control unit 30 may reduce at least one of the magnitude and frequency of a new voltage to be generated by the voltage generation unit 28.

The voltage generation unit 28 generates a new voltage according to the magnitude and the frequency determined by the control unit 30, and applies the new voltage to the electrode unit 22 so that a new electric field can be generated between the electrodes 24 and 26.

If the heating operation of the air conditioner is terminated during the operation of the anti-freeze apparatus 20 or if the outdoor heat exchanger 4 satisfies a set of anti-freeze release conditions, the control unit 30 terminates the operation of the anti-freeze operation (S5, S6 and S7).

The anti-freeze initiation conditions are the conditions in which a temperature measurement provided by the load sensing unit 40 exceeds a reference temperature. For example, if an outdoor temperature sensed by the outdoor temperature sensor 48 or a temperature of the outdoor heat exchanger 4 detected by the outdoor heat exchanger temperature sensor 42 is higher than the freezing point of water or if the difference between an inlet temperature sensed by the inlet temperature sensor 44 and an outlet temperature sensed by the outlet temperature sensor 46 is greater than a reference value, it may be determined that the outdoor heat exchanger 4 satisfies the anti-freeze release conditions. For convenience, assume that the outdoor heat exchanger 4 satisfies the anti-freeze release conditions because the temperature of the outdoor heat exchanger 4 is higher than a reference temperature of, for example, 0° C.

That is, if the heating operation of the air conditioner is terminated or if the temperature measurement provided by the load sensing unit 40 is higher than a reference temperature, the control unit 30 may terminate the operation of the anti-freeze apparatus 20. Then, the voltage applied to the electrodes 24 and 26 of the electrode unit 22 is cut off so that no electric field can be generated in the outdoor heat exchanger 4.

Figure 13:
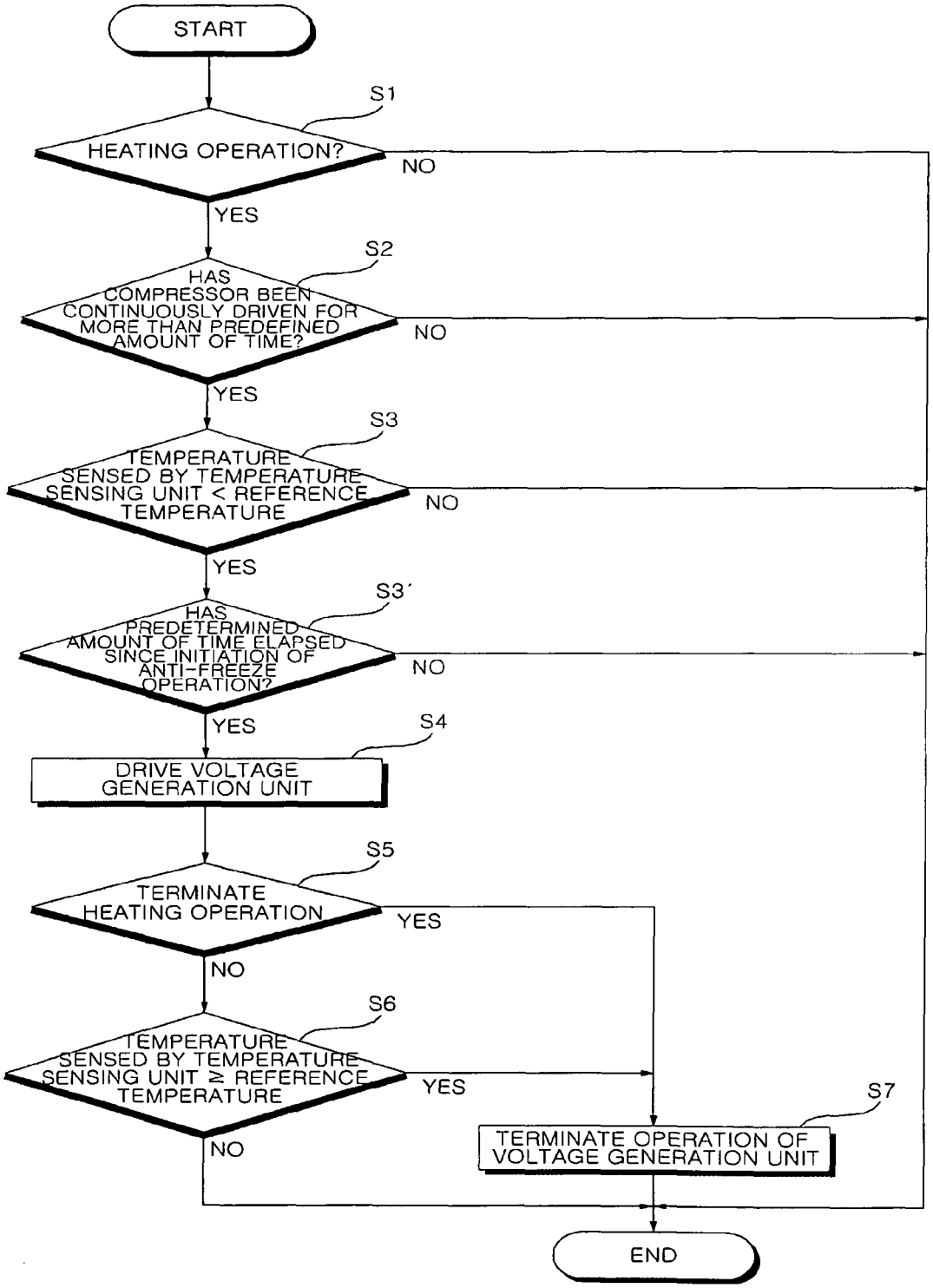
FIG. 13 illustrates a flowchart of a method of controlling an air conditioner according to another embodiment of the present invention.

FIG. 13 illustrates a flowchart of a method of controlling an air conditioner according to another embodiment of the present invention. The method of the embodiment of FIG. 13 is the same as the method of the embodiment of FIG. 12 except that a set of conditions for deciding whether to drive the anti-freeze apparatus 20 include an elapsed time after the initiation of an anti-freeze operation. Thus, the embodiment of FIG. 13 will hereinafter be described, mainly focusing on the differences with the embodiment of FIG. 12.

Referring to FIG. 13, if the air conditioner is currently performing a heating operation, the compressor 2 has been continuously driven for more than a predefined amount of time, a temperature measurement provided by the load sensing unit 40 is lower than a reference temperature and a predetermined amount of time has elapsed since the initiation of an anti-freeze operation, the control unit 30 may decide to drive the anti-freeze apparatus 20 (S1, S2, S3, S3' and S4).

That is, the control unit 30 may decide whether to drive the anti-freeze apparatus 20 according to whether the air conditioner is currently performing a heating operation, whether the compressor 2 has been continuously driven for more than a predefined amount of time, whether a temperature measurement provided by the load sensing unit 40 is lower than a reference temperature and whether a predetermined amount of time has elapsed since the initiation of an anti-freeze operation. Therefore, it is possible to prevent an anti-freeze operation from being unnecessarily performed.

Operations S5, S6 and S7 of FIG. 13 are the same as their respective counterparts of FIG. 12, and thus, detailed descriptions thereof will be skipped.

Figure 14:
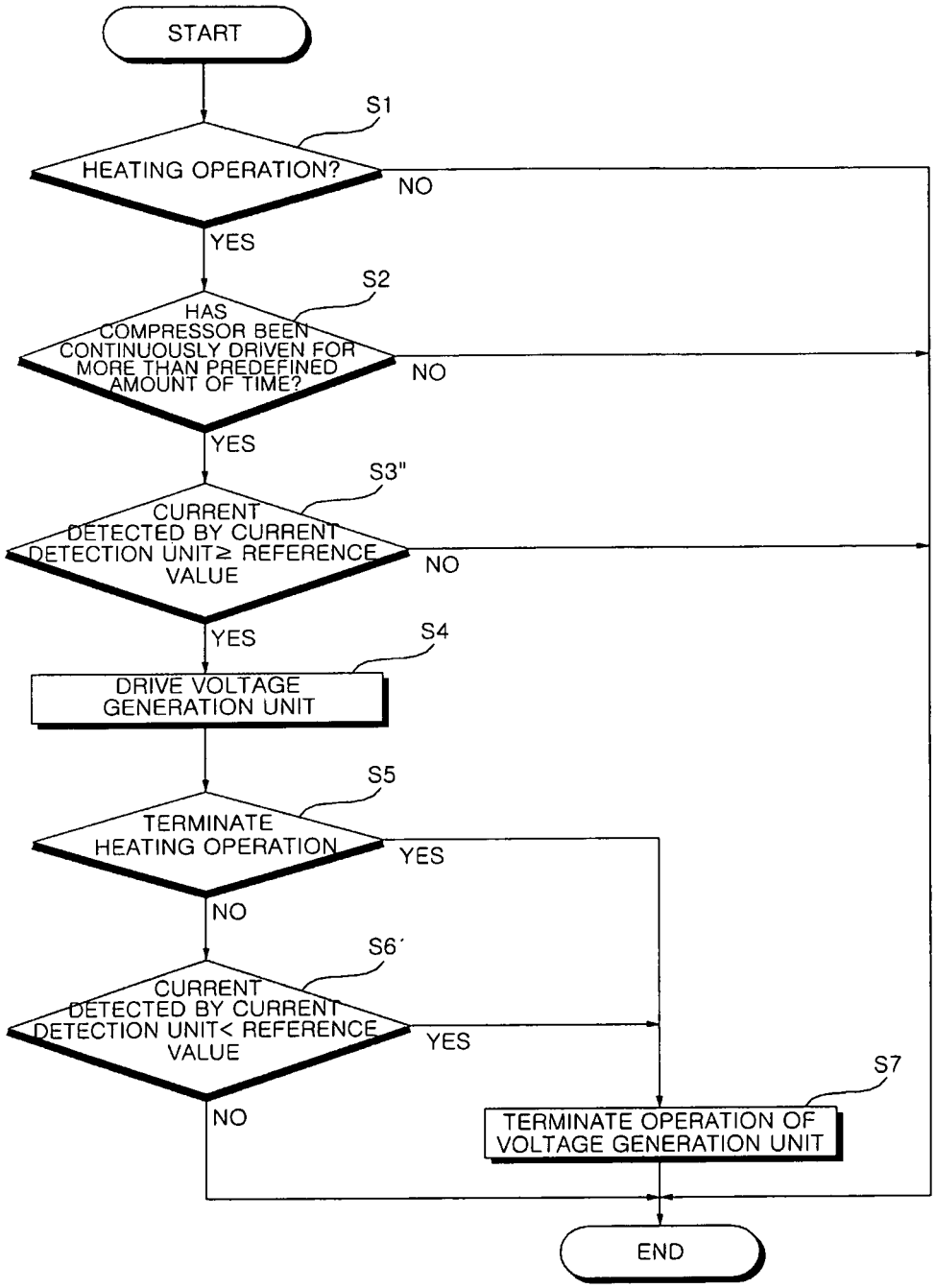
FIG. 14 illustrates a flowchart of a method of controlling an air conditioner according to another embodiment of the present invention.

FIG. 14 illustrates a flowchart of a method of controlling an air conditioner according to another embodiment of the present invention. The method of the embodiment of FIG. 14 is the same as the method of the embodiment of FIG. 12 except that an anti-freeze initiation condition includes whether a current detected by the current detection unit 40' has reached a reference value. Thus, the embodiment of FIG. 14 will hereinafter be described, mainly focusing on the differences with the embodiment of FIG. 12.

Referring to FIG. 14, if the air conditioner is currently performing a heating operation, the compressor 2 has been continuously driven for more than a predefined amount of time, and a current detected by the current detection unit 40' is higher than a reference value, the control unit 30 may decide to drive the anti-freeze apparatus 20 (S1, S2, S3" and S4).

If a variation in the current detected by the current detection unit 40' is detected during the operation of the anti-freeze apparatus 20, the control unit 30 may adjust at least one of the magnitude and the frequency of a voltage generated by the voltage generation unit 28.

The control unit 30 may determine the magnitude and the frequency of a new voltage to be generated by the voltage generation unit 28 by substituting the current detected by the current detection unit 40' into an equation or a table.

More specifically, if the temperature measurement provided by the temperature sensing unit 40, the control unit 30 may increase at least one of the magnitude and frequency of a new voltage to be generated by the voltage generation unit 28. On the other hand, if the temperature measurement provided by the temperature sensing unit 40, the control unit 30 may reduce at least one of the magnitude and frequency of a new voltage to be generated by the voltage generation unit 28.

The voltage generation unit 28 generates a new voltage according to the magnitude and the frequency determined by the control unit 30, and applies the new voltage to the electrode unit 22 so that a new electric field can be generated between the electrodes 24 and 26.

Then, if the heating operation of the air conditioner is terminated during the operation of the anti-freeze apparatus 20 or if the outdoor heat exchanger 4 satisfies an anti-freeze release condition, the control unit 30 terminates the operation of the anti-freeze operation (S5, S6' and S7).

The anti-freeze release condition may include whether the current detected by the current detection unit 40' is lower than the reference value.

That is, if the heating operation of the air conditioner is terminated during the operation of the anti-freeze apparatus 20 or if the current detected by the current detection unit 40' is lower than the reference value, the control unit 30 may terminate the operation of the anti-freeze apparatus 20, and cut off the voltage applied to the voltages 24 and 26 of the electrode unit 22 so that no electric field can be generated in the outdoor heat exchanger 4.

Figure 15:
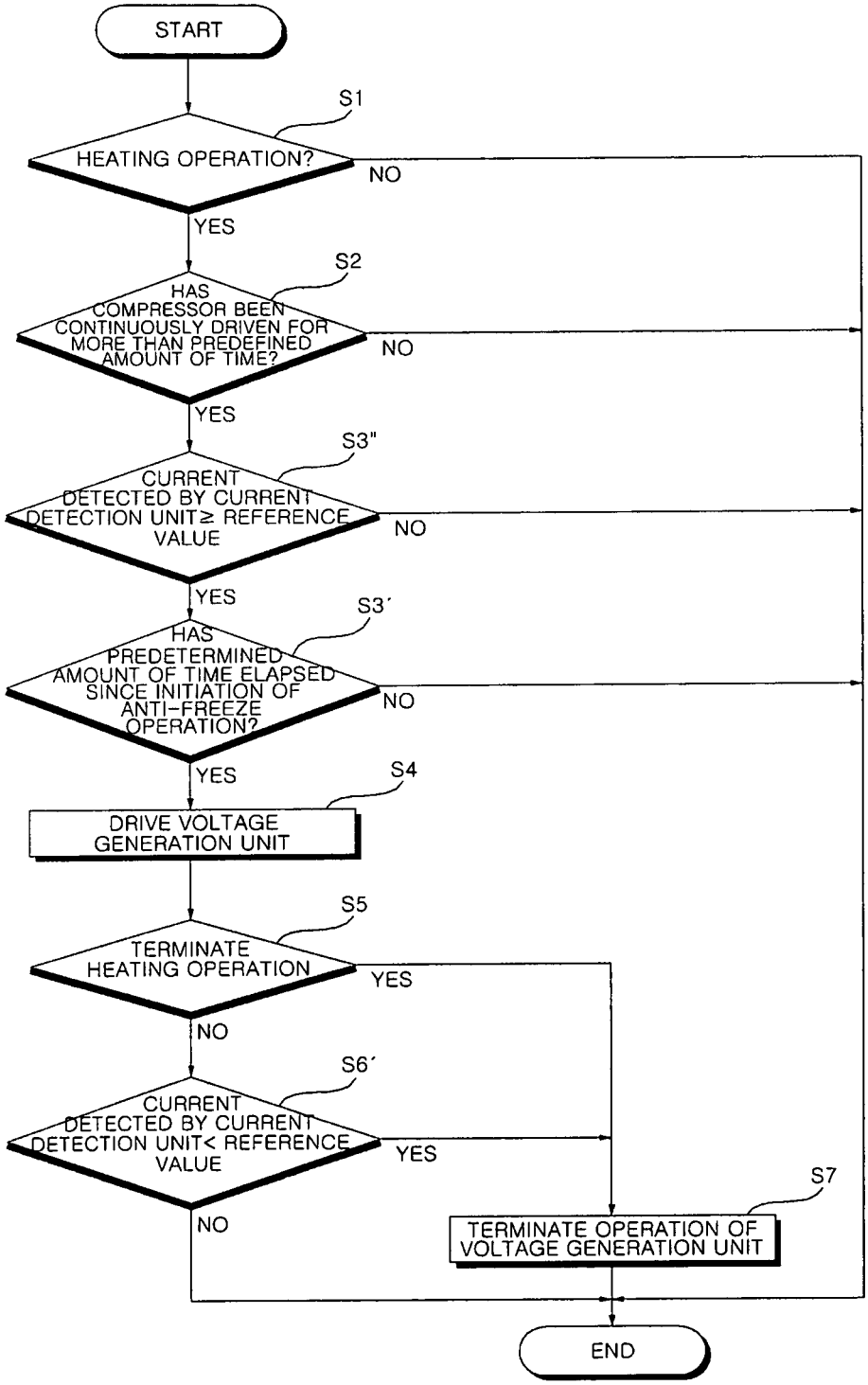
FIG. 15 illustrates a flowchart of a method of controlling an air conditioner according to another embodiment of the present invention.

FIG. 15 illustrates a method of controlling an air conditioner according to an embodiment of the present invention. The method of the embodiment of FIG. 15 is the same as the method of the embodiment of FIG. 12 except that a set of conditions for deciding whether to drive the anti-freeze apparatus 20 include an elapsed time after the initiation of an anti-freeze operation, and that an anti-freeze initiation condition includes whether a current detected by the current detection unit 40' has reached a reference value. Thus, the embodiment of FIG. 15 will hereinafter be described, mainly focusing on the differences with the embodiment of FIG. 12.

Referring to FIG. 15, if the air conditioner is currently performing a heating operation, the compressor 2 has been continuously driven for more than a predefined amount of time, a current detected by the current detection unit 40' is higher than a reference value, and a predetermined amount of time has elapsed since the initiation of an anti-freeze operation, the control unit 30 may decide to drive the anti-freeze apparatus 20 (S1, S2, S3", S3' and S4).

Then, if the heating operation of the air conditioner is terminated during the operation of the anti-freeze apparatus 20 or if the outdoor heat exchanger 4 satisfies an anti-freeze release condition, the control unit 30 terminates the operation of the anti-freeze operation (S5, S6' and S7).

The anti-freeze release condition may include whether the current detected by the current detection unit 40? is lower than the reference value.

That is, if the heating operation of the air conditioner is terminated during the operation of the anti-freeze apparatus 20 or if the current detected by the current detection unit 40' is lower than the reference value, the control unit 30 may terminate the operation of the anti-freeze apparatus 20, and cut off the voltage applied to the voltages 24 and 26 of the electrode unit 22 so that no electric field can be generated in the outdoor heat exchanger 4.

INDUSTRIAL APPLICABILITY

According to the present invention, it is determined whether to drive an anti-freeze apparatus and whether to terminate an operation of the anti-freeze apparatus based on the operating conditions of an air conditioner. Therefore, the present invention can be used in an air conditioner for effectively preventing the freeze of water on the surface of an outdoor heat exchanger.

The invention claimed is:

1. An air conditioner comprising:

a heat exchanger which exchanges heat with air by passing a coolant therethrough;

an anti-freeze apparatus which prevents the freeze of water on the surface of the heat exchanger supplying energy to the heat exchanger; and a control until which controls the anti-freeze apparatus according to operating conditions of the air conditioner, wherein the anti-freeze apparatus comprises:

an electrode unit which includes a plurality of electrodes that generate an electric field in the heat exchanger; and a voltage generation unit which applies a voltage to the electrodes, the air conditioner further comprises a current detection unit which detects a current that flows into the electrode unit, wherein the control until controls the voltage generation unit according to the result of the detection performed by the current detection unit, wherein the control unit does not apply a voltage to the voltage generation unit if the result of the detection performed by the current detection unit is 0.

2. A method of controlling an air conditioner, the method comprising:

if an air conditioner performs a heating operation, a compressor has been driven for more than a reference time, a predetermined amount of time has elapsed since the initiation of an anti-freeze operation and an outdoor heat exchanger satisfies a set of anti-freeze initiation conditions, supplying energy by driving the anti-freeze apparatus so that water on the surface of the heat exchanger can be prevented from freezing, wherein, if the anti-freeze apparatus comprises an electrode unit which includes a plurality of electrodes that generate an electric field in the heat exchanger and a voltage generation unit which applies a voltage to the electrodes, the anti-freeze initiation conditions comprise whether the result of detection performed by a current detection unit, which detects a current that flows into the electrode unit, is higher than a reference value.

3. The method of claim 2, further comprising, if the heat exchanger satisfies a set of anti-freeze release conditions, terminating an operation of the anti-freeze apparatus, wherein the anti-freeze release conditions comprise whether the heating operation has been terminated or whether the result of the detection performed by the current detection unit is lower than the reference value.

* * * * *